US010377599B2

(12) United States Patent
Chou et al.

(10) Patent No.: US 10,377,599 B2
(45) Date of Patent: Aug. 13, 2019

(54) CONVEY PATH SWITCHING MODULE, PAPER SHEET HANDLING MODULE AND PAPER SHEET HANDLING APPARATUS

(71) Applicant: Masterwork Automodules Tech Corp. Ltd, Taipei (TW)

(72) Inventors: Hung-Hsun Chou, Taipei (TW); Poobalan Subramani, Taipei (TW); Wen-Hsien Tsai, Taipei (TW)

(73) Assignee: Masterwork Automodules Tech Corp. Ltd, Taipei (TW)

( * ) Notice: Subject to any disclaimer, the term of this patent is extended or adjusted under 35 U.S.C. 154(b) by 0 days.

(21) Appl. No.: 15/891,372

(22) Filed: Feb. 8, 2018

(65) Prior Publication Data

US 2018/0370746 A1 Dec. 27, 2018

(30) Foreign Application Priority Data

Jun. 27, 2017 (TW) ..... 106121487 A

(51) Int. Cl.
*B65H 29/60* (2006.01)
*B65H 29/58* (2006.01)
(Continued)

(52) U.S. Cl.
CPC ..... *B65H 29/60* (2013.01); *B65H 7/20* (2013.01); *B65H 29/58* (2013.01); *B65H 43/04* (2013.01);
(Continued)

(58) Field of Classification Search
CPC .. B65H 29/60; B65H 29/58; B65H 2404/632; B65H 2404/631; G07D 11/18
See application file for complete search history.

(56) References Cited

U.S. PATENT DOCUMENTS 6,196,464 B1 3/2001 Patterson et al.
6,286,831 B1 9/2001 Marasco et al.
(Continued)

FOREIGN PATENT DOCUMENTS

EP 0915436 3/2001
EP 1544144 11/2007
EP 2772888 9/2014

OTHER PUBLICATIONS

"Search Report of European Counterpart Application," dated Aug. 27, 2018, pp. 1-7.

*Primary Examiner* — Patrick Cicchino
(74) *Attorney, Agent, or Firm* — JCIPRNET

(57) ABSTRACT

A convey path switching module includes a body and a switching mechanism. The body has first, second and third convey paths. The switching mechanism includes a first switching assembly, a first actuator, a second switching assembly and at least one elastic member. The first actuator drives the first switching assembly to pivotally rotate. The second switching assembly is adapted to pivotally rotate and is restored by an elastic force of the elastic member. By pivotally rotating of the first and second switching assemblies, the switching mechanism is switched to a first state to open the first convey path and close the second and third convey paths, is switched to a second state to open the second convey path and close the first and third convey paths, and is switched to a third state to open the third convey path and close the first and second convey paths.

9 Claims, 12 Drawing Sheets

(51) Int. Cl.

| | |
|---|---|
| ***B65H 7/20*** | (2006.01) |
| ***B65H 3/04*** | (2006.01) |
| ***G07D 11/18*** | (2019.01) |
| ***B65H 43/04*** | (2006.01) |

(52) U.S. Cl.
CPC ..... *G07D 11/18* (2019.01); *B65H 2301/3125* (2013.01); *B65H 2403/942* (2013.01); *B65H 2404/1441* (2013.01); *B65H 2404/631* (2013.01); *B65H 2404/632* (2013.01); *B65H 2701/1912* (2013.01)

(56) References Cited

U.S. PATENT DOCUMENTS

| | | | | |
|---|---|---|---|---|
| 6,398,212 | B1 | 6/2002 | Miyake | |
| 6,572,105 | B2 * | 6/2003 | Baker | B65H 29/60 271/302 |
| 6,981,636 | B2 | 1/2006 | Gallo-Hendrikx | |
| 7,108,260 | B2 | 9/2006 | Biegelsen et al. | |
| 7,185,888 | B2 | 3/2007 | Duff et al. | |
| 8,256,604 | B2 | 9/2012 | Ohishi | |
| 8,695,977 | B2 * | 4/2014 | Nunn | B65H 39/10 271/303 |
| 9,260,255 | B2 * | 2/2016 | Yin | B65H 29/58 |
| 10,167,161 | B2 * | 1/2019 | Chang | G07D 11/0033 |
| 2005/0082747 | A1 | 4/2005 | Tamura et al. | |
| 2005/0254872 | A1 * | 11/2005 | Nonaka | G03G 15/6573 399/401 |
| 2009/0066017 | A1 | 3/2009 | Matsuse et al. | |
| 2013/0181397 | A1 * | 7/2013 | Nunn | B65H 39/10 271/303 |
| 2014/0021011 | A1 * | 1/2014 | Yin | B65H 29/58 198/367 |
| 2018/0218558 | A1 * | 8/2018 | Danjo | G07D 9/00 |
| 2018/0300990 | A1 * | 10/2018 | Kim | G07F 19/202 |

* cited by examiner

CONVEY PATH SWITCHING MODULE, PAPER SHEET HANDLING MODULE AND PAPER SHEET HANDLING APPARATUS

CROSS-REFERENCE TO RELATED APPLICATION

This application claims the priority benefit of Taiwan application serial no. 106121487, filed on Jun. 27, 2017. The entirety of the above-mentioned patent application is hereby incorporated by reference herein and made a part of this specification.

BACKGROUND OF THE INVENTION

1. Field of the Invention

The invention relates to a switching module, a paper sheet handling module having the switching module, and a paper sheet handling apparatus having the switching module, and particularly relates to a convey path switching module, a paper sheet handling module having the convey path switching module, and a paper sheet handling apparatus having the convey path switching module.

2. Description of Related Art

To allow users to deposit and withdraw banknotes, a convey channel is provided inside an automatic teller machine (modern ATM) to convey banknotes in correspondence with various operations. To control the conveyance of banknotes in the modern ATM, a switching module is disposed on the convey path inside the modern ATM to switch the convey path of the banknotes.

In some modern ATMs, a single actuator (e.g., an electromagnetic valve) is used with a corresponding component, such as a linking rod, to switch the convey path of the banknotes. However, such design only allows to switch among states of a single convey path, and is unable to efficiently convey the banknotes via various means. Therefore, how to switch among states of a greater number of convey paths when the number of actuators is limited has become an issue in the design for internal banknote conveyance of the modern ATMs.

SUMMARY OF THE INVENTION

Exemplary embodiments of the invention provide a convey path switching module, a paper sheet handling module, and a paper sheet handling apparatus capable of saving the cost for equipment provided with a desirable convey path switching capability.

A convey path switching module according to an embodiment of the invention includes a body and a switching mechanism. The body has a first convey path, a second convey path, and a third convey path adapted to convey an object. The switching mechanism includes a first switching assembly, a first actuator, a second switching assembly and at least one elastic member. The first switching assembly is pivotally connected to the body. The first actuator is connected to the first switching assembly and adapted to drive the first switching assembly to pivotally rotate. The second switching assembly is pivotally connected to the body and adapted to rotate pivotally. The elastic member is connected to the second switching assembly adapted to be restored by an elastic force of the elastic member. Through pivotal rotation of the first switching assembly and pivotal rotation of the second switching assembly, the switching mechanism is adapted to be switched to a first state to open the first convey path and close the second convey path and the third convey path, adapted to be switched to a second state to open the second convey path and close the first convey path and the third convey path, and adapted to be switched to a third state to open the third convey path and close the first convey path and the second convey path.

A paper sheet handling module according to an embodiment of the invention includes a casing, a discrimination module, and a convey path switching module. The casing has an inlet, an outlet, and an opening. A convey path set is provided in the casing. The paper sheet handling module is adapted to receive a paper sheet via the inlet and discharge a paper sheet via the outlet. The discrimination module is disposed in the casing and adapted to discriminate the paper sheet. The convey path switching module is disposed in the casing. The convey path set is adapted to convey the paper sheet from the inlet to the convey path switching module through the discrimination module. The convey path switching module includes a body and a switching mechanism. The body has a first convey path, a second convey path, and a third convey path adapted to convey the paper sheet, and is connected between the convey path set and the opening. The convey path set is adapted to convey the verified paper sheet from the discrimination module to the opening via the second convey path, adapted to convey the verified paper sheet from the discrimination module to the outlet via the first convey path, and adapted to convey the verified paper sheet from the opening to the outlet via the third convey path. The switching mechanism includes a first switching assembly, a first actuator, a second switching assembly and at least one elastic member. The first switching assembly is pivotally connected to the body. The first actuator is connected to the first switching assembly and adapted to drive the first switching assembly to pivotally rotate. The second switching assembly is pivotally connected to the body and adapted to rotate pivotally. The elastic member is connected to the second switching assembly adapted to be restored by an elastic force of the elastic member. Through pivotal rotation of the first switching assembly and pivotal rotation of the second switching assembly, the switching mechanism is adapted to be switched to a first state to open the first convey path and close the second convey path and the third convey path, adapted to be switched to a second state to open the second convey path and close the first convey path and the third convey path, and adapted to be switched to a third state to open the third convey path and close the first convey path and the second convey path.

According to an embodiment of the invention, the paper sheet handling module further includes a temporary storage region disposed in the casing. The convey path set is adapted to convey the paper sheet from the convey path switching module to the temporary storage region.

According to an embodiment of the invention, the first switching assembly includes a first lever and a rotary shaft, the first lever is connected to the rotary shaft, the rotary shaft is pivotally connected to the body and connected to the first actuator, the second switching assembly includes a second lever and a third lever, and the second lever and the third lever are pivotally connected to the rotary shaft.

According to an embodiment of the invention, the number of the at least one elastic member is two, one of the elastic members is connected between the second lever and the rotary shaft, the other of the elastic members is connected between the third lever and the rotary shaft, the second lever is adapted to block the first convey path by an elastic force of the corresponding elastic member and is adapted to resist the elastic force of the elastic member and block the third convey path, and the third lever is adapted to block the second convey path by an elastic force of the corresponding elastic member and adapted to resist the elastic force of the elastic member and block the third convey path.

According to an embodiment of the invention, when the switching mechanism is in the first state, the first lever and the second lever are adapted to guide the object to move unidirectionally along the first convey path, when the switching mechanism is in the second state, the first lever and the third lever are adapted to guide the object to move unidirectionally along the second convey path, and when the switching mechanism is in the third state, the second lever and the third lever are adapted to guide the object to move bidirectionally along the third convey path.

According to an embodiment of the invention, the convey path switching module further includes a second actuator. The second actuator includes a body and a driving member, the driving member is movably disposed to the body and connected to the second lever and the third lever, the elastic member is connected between the body and the driving member, and the driving member is adapted to make the second lever and the third lever respectively block the first convey path and the second convey path by an elastic force of the elastic member and adapted to resist the elastic force of the elastic member to move and drive the second lever and the third lever to block the third convey path.

According to an embodiment of the invention, when the switching mechanism is in the first state, the first lever and the second lever are adapted to guide the object to move bidirectionally along the first convey path, when the switching mechanism is in the second state, the first lever and the third lever are adapted to guide the object to move bidirectionally along the second convey path, and when the switching mechanism is in the third state, the second lever and the third lever are adapted to guide the object to move bidirectionally along the third convey path.

According to an embodiment, the driving member includes a first rod member, a second rod member, and a third rod member, the first rod member is disposed to the body and movable along a linear direction, two ends of the second rod member are respectively pivotally connected to the first rod member and the second lever, and two ends of the third lever are respectively pivotally connected to the first member and the third lever.

According to an embodiment of the invention, when the first lever blocks the second convey path and the second lever blocks the third convey path, the switching mechanism is in the first state, when the first lever blocks the first convey path and the third lever blocks the third convey path, the switching mechanism is in the second state, and when the second lever and the third lever respectively block the first convey path and the second convey path, the switching mechanism is in the third state.

According to an embodiment of the invention, the second lever has a first blocking section, the third lever has a second blocking section, and the first blocking section and the second blocking section are adapted to block each other to limit ranges of pivotal rotation of the second lever and the third lever.

A paper sheet handling apparatus according to an embodiment of the invention includes a paper sheet handling module and a paper sheet storage module. The paper sheet handling module includes a first casing, a discrimination module, and a convey path switching module. The first casing has an inlet, an outlet, a first opening, and a second opening. A convey path set is provided in the casing. The paper sheet handling module is adapted to receive a paper sheet via the inlet and discharge a paper sheet via the outlet. The discrimination module is disposed in the casing and adapted to discriminate the paper sheet. The convey path switching module is disposed in the casing. The convey path set is adapted to convey the paper sheet from the inlet to the convey path switching module through the discrimination module. The convey path switching module includes a body and a switching mechanism. The body has a first convey path, a second convey path, and a third convey path adapted to convey the paper sheet, and is connected among the convey path set, the first opening and the second opening. The convey path set is adapted to convey the verified paper sheet from the discrimination module to the first opening via the second convey path, adapted to convey the verified paper sheet from the discrimination module to the outlet via the first convey path, adapted to convey the verified paper sheet from the first opening to the outlet via the third convey path, and adapted to convey the verified paper sheet from the discrimination module to the second opening via the first convey path. The switching mechanism includes a first switching assembly and a second switching assembly. The first switching assembly is pivotally connected to the body. The second switching assembly is pivotally connected to the body. In addition, through pivotal rotation of the first switching assembly and pivotal rotation of the second switching assembly, the switching mechanism is adapted to be switched to a first state to open the first convey path and close the second convey path and the third convey path, adapted to be switched to a second state to open the second convey path and close the first convey path and the third convey path, and adapted to be switched to a third state to open the third convey path and close the first convey path and the second convey path. The paper sheet storage module includes a second casing, at least one circulating storage box, and a non-circulating storage box. The second casing has a third opening and a fourth opening, and the third opening and the fourth opening are respectively aligned to the first opening and the second opening. A path of the convey path set connected to the convey path switching module passes through the first opening and the third opening and is branched into at least one first branched path. Another path of the convey path set connected to the convey path switching module passes through the second opening and the fourth opening and is branched into a second branched path. The at least one circulating storage box is disposed on the first branched path and adapted to store paper sheets, and the non-circulating storage box is disposed on the second branched path and adapted to store rejected paper sheets.

Based on the above, in the convey path switching module according to the embodiments of the invention, switching among the first convey path, the second convey path, and the third convey path is achieved through rotation of the first switching assembly and the second switching assembly. In an embodiment, the first lever of the first switching assembly is driven by the first actuator to pivotally rotate, and is thus an active switching assembly, whereas the second lever of the second switching assembly resists the elastic force of the elastic member to pivotally rotate through pressing of the paper sheet and is thus a passive switching assembly. In other words, with the single actuator (the first actuator) driving one of the switching assemblies (i.e., the first switching assembly) to pivotally rotate, switching among the states of three convey paths (i.e., the first convey path, the second convey path, and the third convey path) is achieved. Thus, the switching among the states of the three convey paths is achieved without requiring multiple first actuators. Therefore, the required quantity of the actuators is reduced, and the equipment cost is consequently reduced. In addition, to desirable convey path switching capability is demonstrated. In another embodiment, the first lever of the first switching assembly is driven by the first actuator to pivotally rotate, and the second lever and the third lever of the second switching assembly are driven by the second actuator to pivotally rotate. In other words, with only two actuators (i.e., the first actuator and the second actuator), three levers (i.e., the first lever, the second lever, and the third lever) may rotate pivotally to switch the states among three convey paths (i.e., the first convey path, the second convey path, and the third convey path). Therefore, such configuration does not require three actuators to switch the states among the three convey paths. Consequently, the required quantity of the actuators is reduced, and the equipment cost is reduced. In addition, a desirable convey path switching capability is demonstrated.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
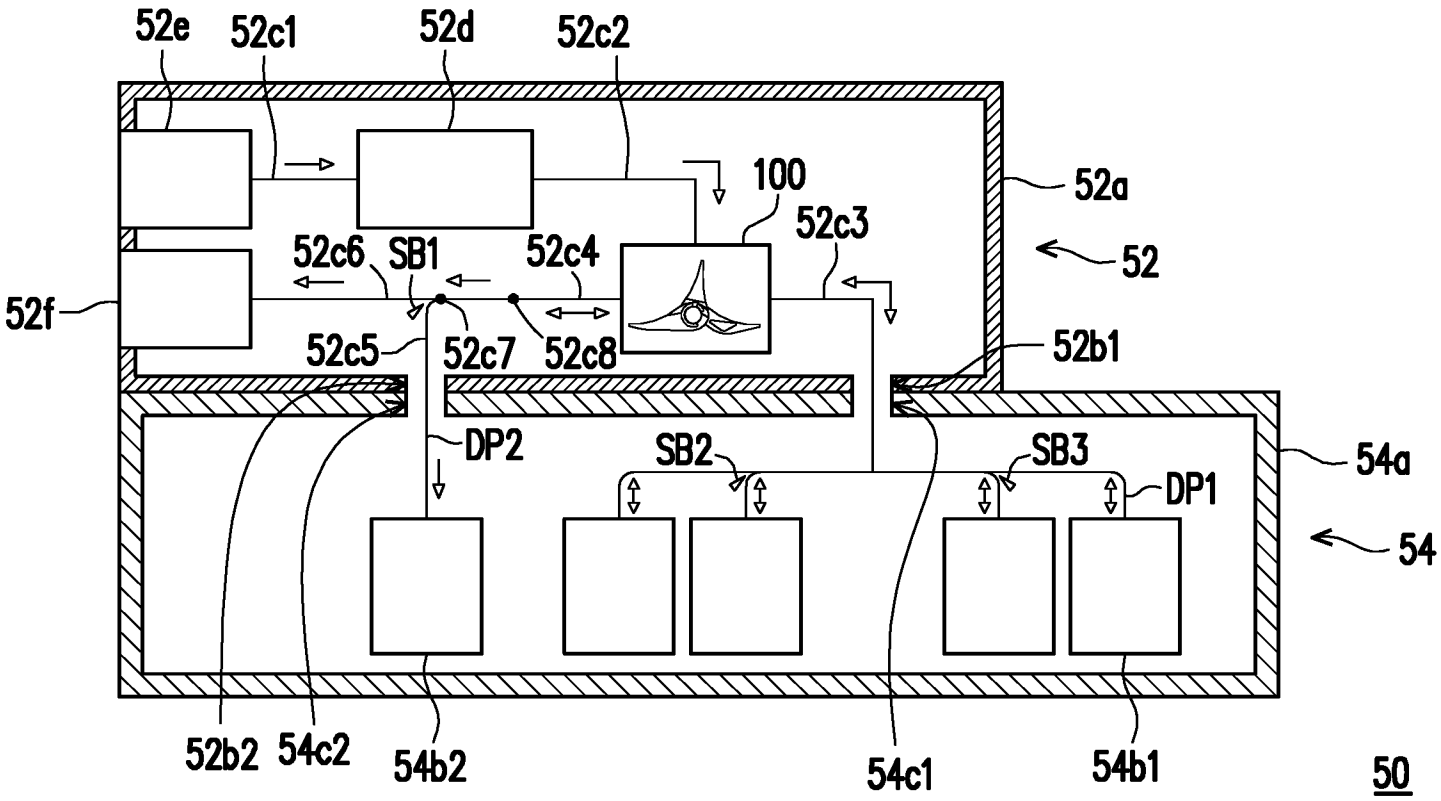
FIG. 1 is a schematic view illustrating a paper sheet handling apparatus according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic view illustrating a paper sheet handling apparatus according to an embodiment of the invention. Referring to FIG. 1, a paper sheet handling apparatus 50 of the embodiment is an automatic teller machine (modern ATM), for example, and includes a paper sheet handling module 52 and a paper sheet storage module 54, wherein the modern ATM could be cash deposit machine, cash withdrawal machine, cash deposit/withdrawal machine, cash recycler machine or the like, and the invention is not limited thereto. The paper sheet handling module 52 includes a casing 52*a*, a discrimination module 52*d*, and a convey path switching module 100. The discrimination module 52*d* and the convey path switching module 100 are disposed inside the casing 52*a*. The casing 52*a* has a first opening 52*b*1 and a second opening 52*b*2. A convey path set and the discrimination module 52*d* are provided in the casing 52*a*. The convey path set includes convey paths 52*c*1 to 52*c*6, and the casing 52*a* has an inlet 52*e* and an outlet 52*f*. The paper sheet handling module 52 is adapted to receive a paper sheet via the inlet 52*e*, and is adapted to discharge a paper sheet via the outlet 52*f*. The paper sheet is a banknote, a check, or other suitable paper sheets. The invention does not intend to impose a limitation on this regard. The discrimination module 52*d* is adapted to discriminate the quality, denomination, and validity of a banknote. The banknote verified by the discrimination module may be classified into a real banknote or a counterfeit banknote. Besides, based on the banknote quality, a real banknote may be further classified into a normal banknote or a rejected banknote. Normal banknotes have a better quality and are suitable for circulation on the market, and rejected banknotes are determined by the discrimination module as having a poor quality and not suitable for circulation. Banknotes not suitable for circulation include banknotes with defectiveness to a certain extent, such as those having defects, including banknotes mutilated, torn, and/or having soil, tape, folded corners, wrinkles, and/or graffiti, and/or the like. These defective banknotes are determined by the discrimination module as having a chance of being rejected by the users and not suitable for circulation on the markets. The paper sheet storage module 54 is adapted to store paper sheets, for example, and includes a casing 54*a*, a plurality of circulating storage boxes 54*b*1 in the casing 54*a* and a non-circulating storage box 54*b*2 located in the casing 54*a*. The casing 54*a* has a third opening 54*c*1 and a fourth opening 54*c*2 respectively aligned to the first opening 52*b*1 and the second opening 52*b*2 of the casing 52*a* of the paper sheet handling module 52. To secure authenticated banknotes, the casing 54*a* of the paper sheet storage module 54 may be a safe case having a higher security level, for example. The casing 52*a* of the paper sheet handling module 52 may also be a safe case. The invention does not intend to impose a limitation on this regard.

A path (e.g., the convey path 52*c*3) of the convey path set connected to the convey path switching module 100 passes through the first opening 52*b*1 and the third opening 54*c*1, and is branched into at least one first branched path DP1 (shown as plural). Another path (e.g., the convey path 52*c*4) of the convey path set connected to the convey path switching module 100 passes through the second opening 52*b*2 and the fourth opening 54*c*2, and is branched into a second branched path DP2. The circulating storage boxes 54*b*1 are respectively disposed on the first branched paths DP1 and are adapted to store paper sheets. The non-circulating storage box 54*b*2 is disposed on the second branched path DP2 and is adapted to store paper sheets. In addition, the circulating storage boxes 54*b*1 are adapted to store real and normal banknotes, for example, whereas the non-circulating storage box 54*b*2 is adapted to store rejected banknotes that are real banknotes but of a poor quality, for example. However, the invention is not limited thereto.

A paper sheet (e.g., a banknote) or other types of objects are adapted to be received into the paper sheet handling module 52 via the inlet 52*e* and be discharged out of the paper sheet handling module 52 via the outlet 52*f*. Specifically, the convey path set is adapted to convey a paper sheet from the inlet 52*e* to the convey path switching module 100 through the convey path 52*c*1 and the discrimination module 52*d*, adapted to convey a paper sheet from the discrimination module 52*d* to the first opening 52*b*1 for conveyance toward the circulating storage boxes 54*b*1 through the convey path 52*c*2, a second convey path P2 (shown in FIGS. 4, 5A, and 5B), and the convey path 52*c*3, adapted to convey a paper sheet from the discrimination module 52*d* to the outlet 52*f* through the convey path 52*c*2, a first convey path P1 (shown in FIGS. 4, 5A, and 5B), the convey path 52*c*4, and the convey path 52*c*6, adapted to convey a paper sheet from the discrimination module 52*d* to the second opening 52*b*2 for conveyance toward the non-circulating storage box 54*b*2 through the convey path 52*c*2, the first convey path P1 (shown in FIGS. 4, 5A, and 5B), the convey path 52*c*4, and the convey path 52*c*5, and adapted to convey a paper sheet from the first opening 52*b*1 to the outlet 52*f* through the convey path 52*c*3, a third convey path P3 (shown in FIGS. 4, 5A, and 5B), the convey path 52*c*4, and the convey path 52*c*6. In the embodiment, the circulating storage boxes 54*b*1 are adapted to respectively store banknotes of different denominations verified by the discrimination module 52*d*, for example. Through switching of paths by means of banknote dispatching rods SB2 and SB3 above the circulating storage boxes 54*b*1, the banknotes are able to be smoothly placed into the specific circulating storage boxes 54*b*1.

In the embodiment, the convey path 52*c*5 and the convey path 52*c*6 are unidirectional, and the convey path 52*c*5 and the convey path 52*c*6 are connected at a node 52*c*7. In addition, a path may be set at a node 52*c*8 of the convey path set to achieve the unidirectional path. Moreover, at the node 52*c*7, a paper sheet is switched to be moved toward the convey path 52*c*5 or the convey path 52*c*6 by a banknote dispatching rod SB1. Accordingly, the convey path 52*c*3 of the embodiment is bidirectional, and the paper sheet handling apparatus 50 is correspondingly a banknote withdrawing apparatus. In another embodiment, the convey path 52*c*3 may be unidirectional, and the paper sheet handling apparatus 50 is correspondingly a banknote depositing apparatus. The connection relations and the unidirectionality or bidirectionality of the convey paths are described above merely as an example, and the invention is not limited thereto.

Figure 2:
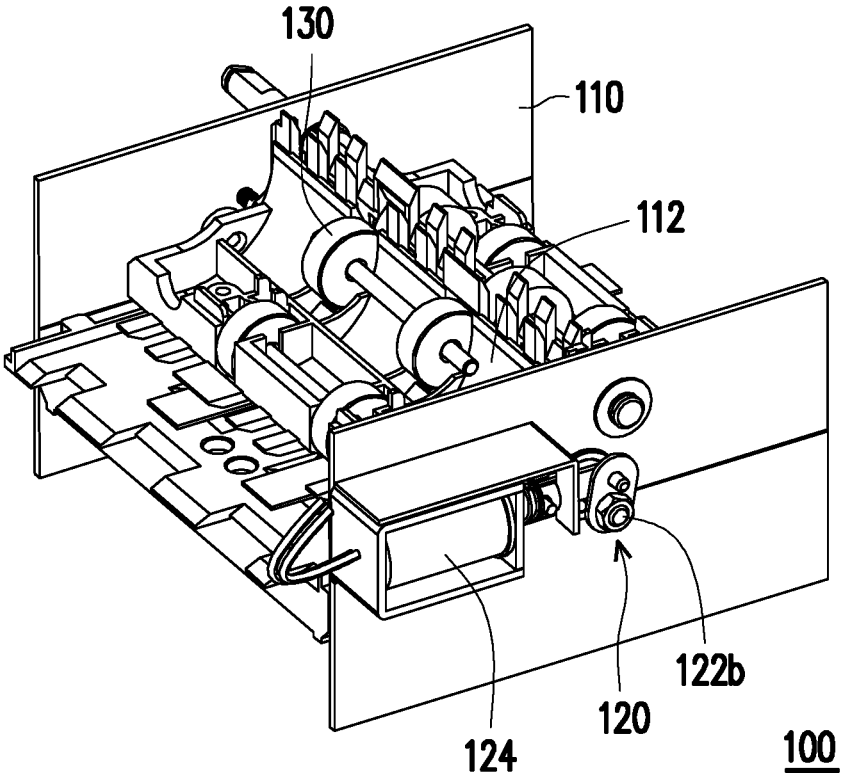
FIG. 2 is a perspective view illustrating a convey path switching module of FIG. 1.
Figure 3:
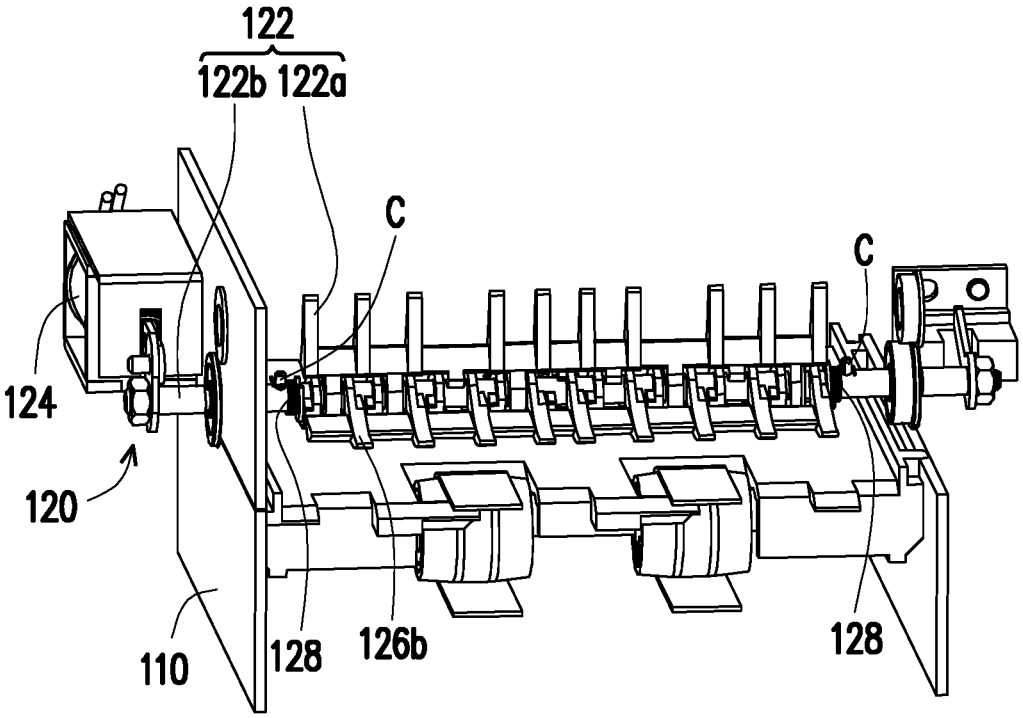
FIG. 3 is a perspective view illustrating some components of the convey path switching module of FIG. 2 from another perspective.
Figure 4:
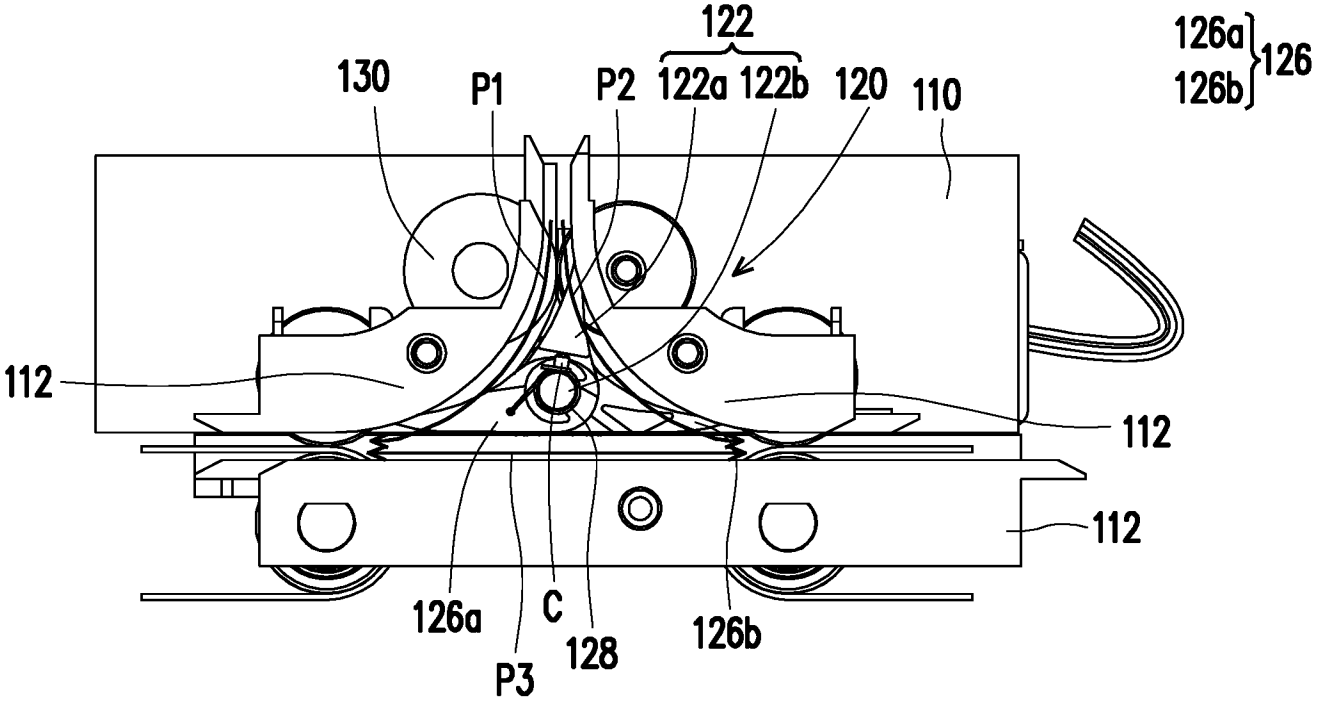
FIG. 4 is a side view illustrating some components of the convey path switching module of FIG. 2.

FIG. 2 is a perspective view illustrating a convey path switching module of FIG. 1. FIG. 3 is a perspective view illustrating some components of the convey path switching module of FIG. 2 from another perspective. FIG. 4 is a side view illustrating some components of the convey path switching module of FIG. 2. Referring to FIGS. 2 to 4, in the embodiment, the convey path switching module 100 includes a body 110 and a switching mechanism 120. The body 110 includes the first convey path P1, the second convey path P2, and the third convey path P3 (shown in FIG. 4) adapted to convey the paper sheet. One end of the first convey path P1 intersects one end of the second convey path P2. The other end of the first convey path P1 intersects one end of the third convey path P3 and is connected to an opening 52*b* shown in FIG. 1. The other end of the second convey path P2 intersects the other end of the third convey path P3 and is connected to another opening 52*b* shown in FIG. 1. A plurality of rollers 130 disposed at the body 110 are adapted to drive the paper sheet to move along the first convey path P1, the second convey path P2 or the third convey path P3. In the embodiment, the first convey path P1, the second convey path P2, and the third convey path P3 are formed by a note channel 112 of the body 110 and the switching mechanism 120.

The switching mechanism 120 includes a first switching assembly 122, a first actuator 124, a second switching assembly 126, and at least one elastic member 128 (two shown in FIG. 3). The first switching assembly 122 includes a first lever 122*a* and a rotary shaft 122*b*. The first lever 122*a* is connected to the rotary shaft 122*b*, and the rotary shaft 122*b* is pivotally connected to the body 110 and is connected to the first actuator 124. The first actuator 124 is adapted to drive the first switching assembly 122 to pivotally rotate about the rotary shaft 122*b* of the first switching assembly 122 as a center of rotation. The second switching assembly 126 includes a second lever 126*a* and a third lever 126*b*. The second lever 126*a* and the third lever 126*b* are pivotally connected to the rotary shaft 122*b* of the first switching assembly 122. In other words, the second lever 126*a* and the third lever 126*b* are pivotally connected to the body 110 through the rotary shaft 122*b*. An elastic member 128 is connected between the second lever 126*a* and the rotary shaft 122*b*, and another elastic member 128 is connected between the third lever 126*b* and the rotary shaft 122*b*. The second lever 126*a* and the third lever 126*b* of the second switching assembly 126 are adapted to resist an elastic force of the elastic member 128 through pressing of the paper sheet to pivotally rotate, and are adapted to be restored by the elastic force of the elastic member 128.

Figure 5A:
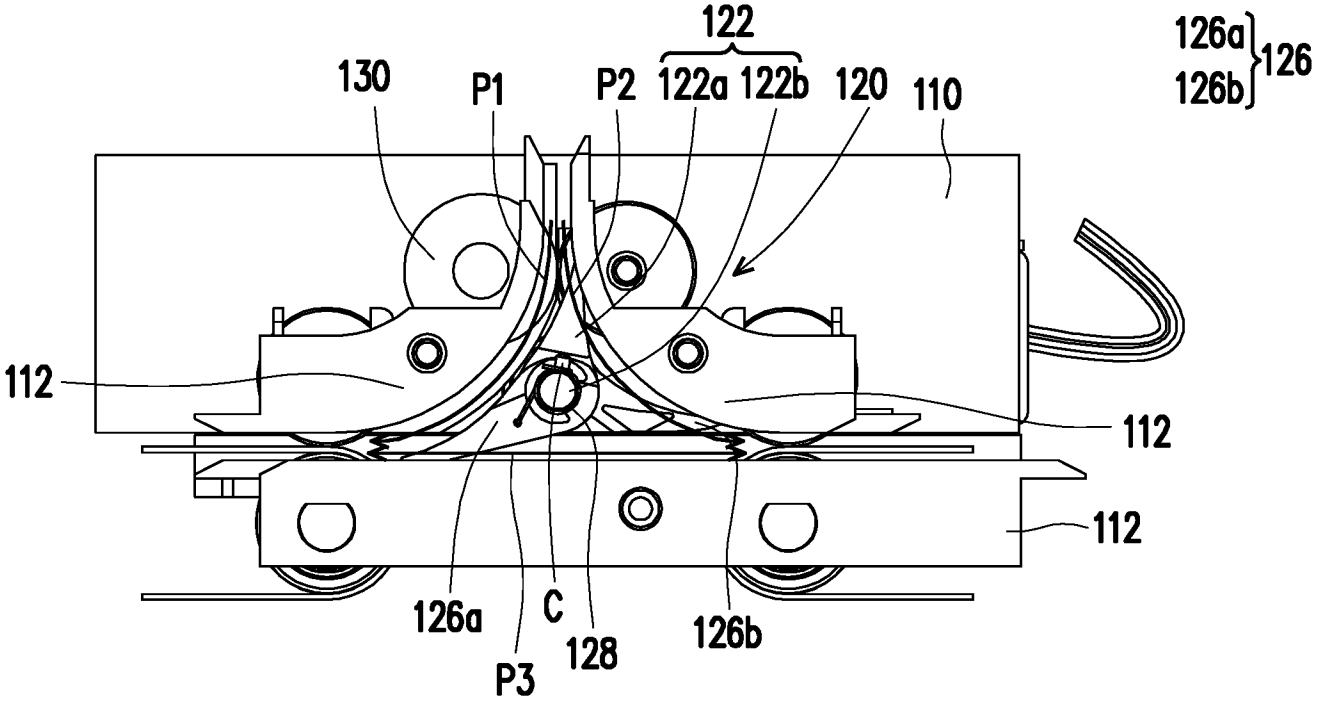
FIGS. 5A and 5B are views illustrating changes of states of a switching mechanism of FIG. 4.
Figure 5B:
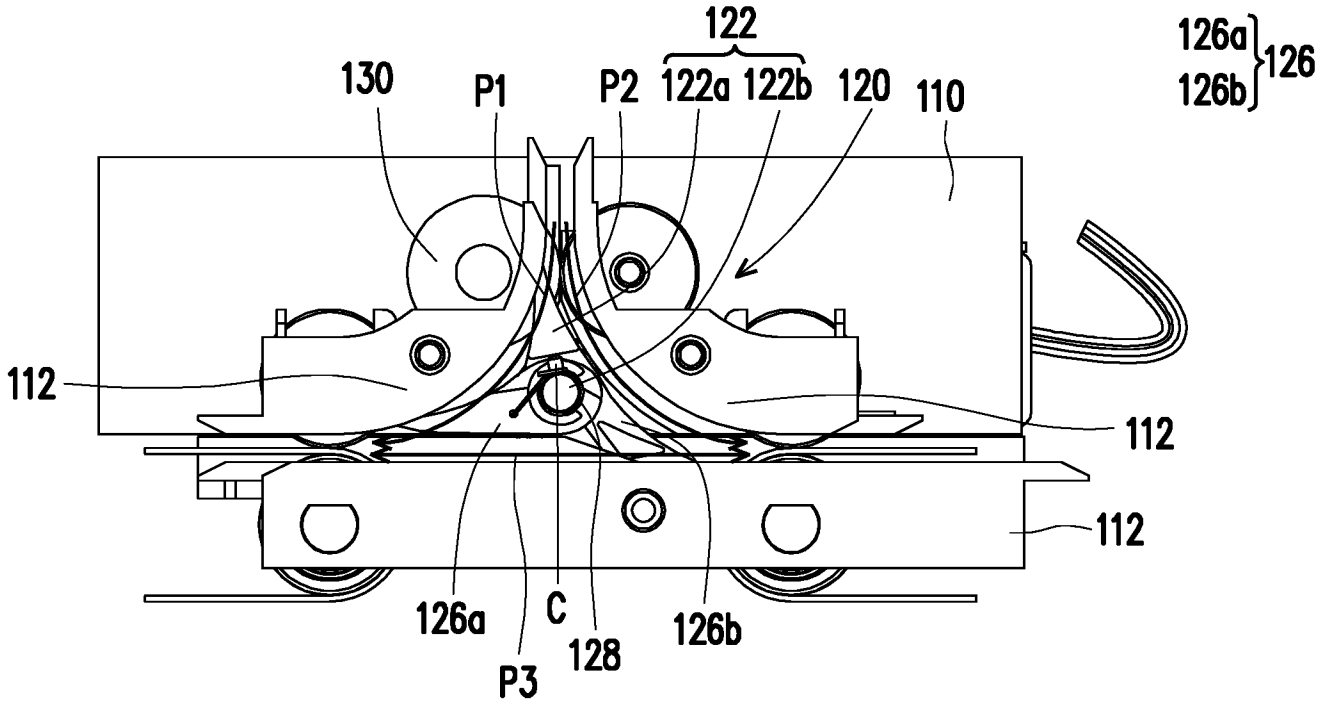

FIGS. 5A and 5B are views illustrating changes of states of a switching mechanism of FIG. 4. Through pivotal rotation of the first lever 122*a* of the first switching assembly 122 and pivotal rotation of the second lever 126*a* and the third lever 126*b* of the second switching assembly 126, the switching mechanism 120 is adapted to be switched to a first state shown in FIG. 5A to open the first convey path P1 and close the second convey path P2 and the third convey path P3, adapted to be switched to a second state shown in FIG. 5B to open the second convey path P2 and close the first convey path P1 and the third convey path P3, and adapted to be switched to a third state shown in FIG. 4 to open the third path P3 and close the first convey path P1 and the second convey path P2.

Specifically, when the first lever 122*a* blocks the second convey path P2 and the second lever 126*a* blocks the third convey path P3, the switching mechanism 120 is in the first state. When the first lever 122*a* blocks the first convey path P1 and the third lever 126*b* blocks the third convey path P3, the switching mechanism 120 is in the second state. When the second lever 126*a* and the third lever 126*b* respectively block the first convey path P1 and the second convey path P2, the switching mechanism 120 is in the third state. In addition, when the paper sheet is not conveyed to the second lever 126*a*, the second lever 126*a* is adapted to block the first convey path P1 as shown in FIGS. 4 and 5 by the elastic force of the corresponding elastic member 128. When the paper sheet is conveyed to the second lever 126*a*, the second lever 126*a* is adapted to resist the elastic force of the elastic member 128 through pressing of the paper sheet, so as to block the third convey path P3 as shown in FIG. 5A.

Similarly, when the paper sheet is not conveyed to the third lever 126*b*, the third lever 126*b* is adapted to block the second path P2 as shown in FIGS. 4 and 5A by the elastic force of the corresponding elastic member 128. When the paper sheet is conveyed to the third lever 126*b*, the third lever 126*b* is adapted to resist the elastic force of the elastic member 128 to block the third convey path P3 as shown in FIG. 5A.

Accordingly, in the convey path switching module 100 of the embodiment, switching among the first convey path P1, the second convey path P2, and the third convey path P3 is achieved through rotation of the first switching assembly 122 and the second switching assembly 126. In addition, the first switching assembly 122 is driven by the first actuator 124 to pivotally rotate, and is thus an active switching assembly, whereas the second switching assembly 126 resists the elastic force of the elastic member 128 to pivotally rotate through pressing of the paper sheet and is thus a passive switching assembly. In other words, with the single first actuator 124 driving one of the switching assemblies (i.e., the first switching assembly 122) to pivotally rotate, switching among the states of three convey paths (i.e., the first convey path P1, the second convey path P2, and the third convey path P3) is achieved. Thus, the switching among the states of the three convey paths is achieved without requiring multiple actuators. Therefore, the required quantity of the actuators is reduced, and the equipment cost is reduced. In addition, the embodiment exhibits a desirable convey path switching capability.

In the embodiment, when the switching mechanism 120 is in the first state, the first lever 122*a* and the second lever 126*a* are adapted to guide the paper sheet to move unidirectionally along the first convey path P1. When the switching mechanism 120 is in the second state, the first lever 122*a* and the third lever 126*b* are adapted to guide the paper sheet to move unidirectionally along the second convey path P2. When the switching mechanism 120 is in the third state, the second lever 126*a* and the third lever 126*b* are adapted to guide the paper sheet to move bidirectionally along the third convey path P3.

Figure 6:
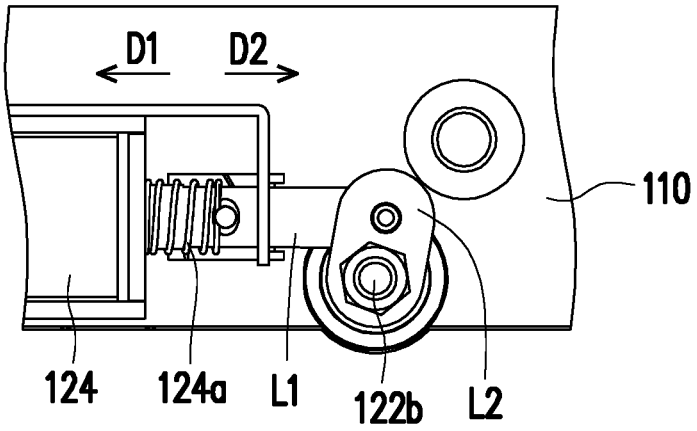
FIG. 6 is a partial side view illustrating the convey path switching module of FIG. 1.

In the following, the elastic member 128 of the embodiment is described in detail. Referring to FIGS. 3, and 4, the elastic member 128 of the embodiment is a torsion spring. One end of the elastic member 128 is hooked to a column C of the rotary shaft 122*b*, and the other end of the elastic member 128 penetrates through the second lever 126*a* or the third lever 126*b*. In the following, the first actuator 124 of the embodiment are described in detail. FIG. 6 is a partial side view illustrating the convey path switching module of FIG. 1. Referring to FIG. 6, the first actuator 124 of the embodiment is an electromagnetic valve, for example. The first actuator 124 is connected to the rotary shaft 122*b* through a linking rod L1 and a linking rod L2. In addition, the linking rod L1 is pivotally connected to the first actuator 124, the linking rod L2 is pivotally connected to the linking rod L1, and the rotary shaft 122*b* is pivotally connected to the linking rod L2. When the first actuator 124 is turned on, the first actuator 124 is adapted to resist an elastic force of an elastic member 124*a* (e.g., a compression string) of the first actuator 124 to drive an end of the linking rod L1 (i.e., the end of the linking rod L1 connected to the first actuator 124) to move along a direction D1, so as to drive the rotary shaft 122*b* to rotate through the linking rod L1 and the linking rod L2. When the first actuator 124 is turned off, the elastic member 124*a* drives an end of the linking rod L1 (i.e., the end of the linking rod L1 connected to the first actuator 124) to be restored along a direction D2 by the elastic force of the elastic member 124*a*. Accordingly, the first lever 122*a* is operable between the state shown in FIG. 4 (or FIG. 5A) or the state shown in FIG. 5B.

Figure 7:
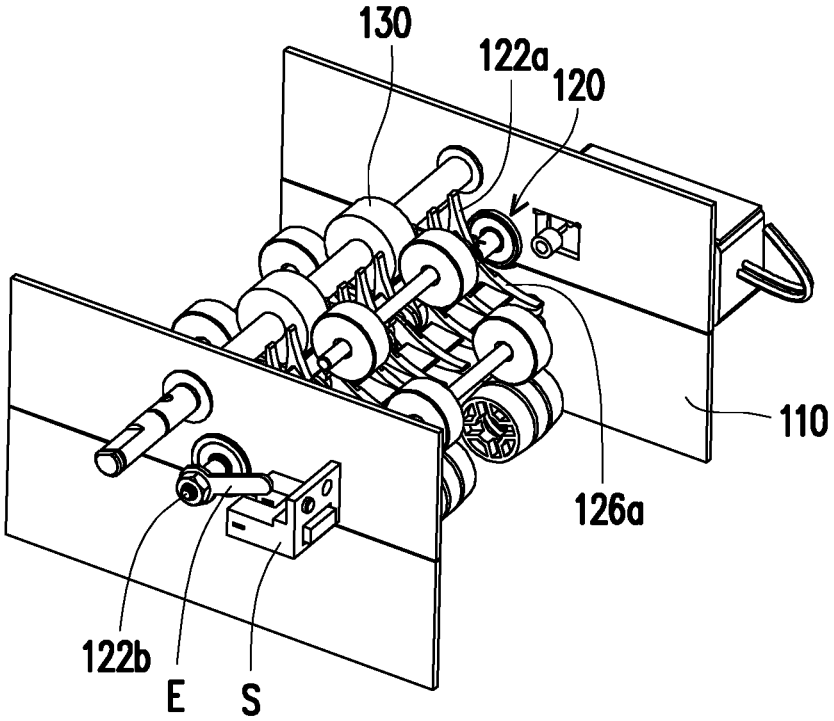
FIG. 7 is a perspective view illustrating the convey path switching module of FIG. 1 from another perspective.

FIG. 7 is a perspective view illustrating the convey path switching module of FIG. 1 from another perspective. Referring to FIG. 7, an extension section E may be disposed on the rotary shaft 122*b* of the embodiment. In addition, a sensor S is correspondingly disposed on the body 110. The extension section E may move toward or away from the sensor S as the rotary shaft 122*b* rotates. Accordingly, the sensor S may determine the state of the first lever 122*a* by sensing the extension section E and thereby control the switching mechanism 120.

Figure 8:
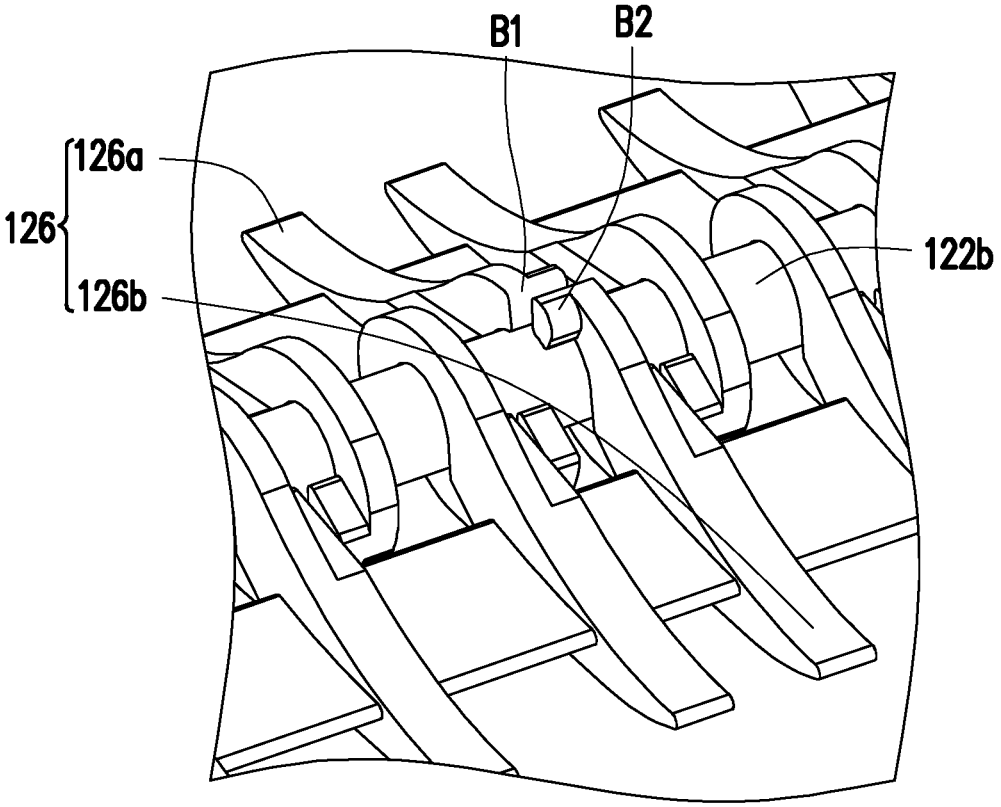
FIG. 8 is a partial perspective view illustrating the convey path switching module of FIG. 1.

FIG. 8 is a partial perspective view illustrating the convey path switching module of FIG. 1. In the embodiment, the second lever 126*a* has a first blocking section B1, and the third lever 126*b* has a second blocking section B2. The first blocking section B1 and the second blocking section B2 are adapted to block each other to limit ranges of pivotal rotation of the second lever 126*a* and the third lever 126*b*. Accordingly, the second lever 126*a* and the third lever 126*b* are prevented from being excessively lifted due to the elastic force of the elastic member 128 (shown in FIG. 3) during an assembling process of the convey path switching module 100. Therefore, assembling and maintenance may be carried out smoothly.

Figure 9:
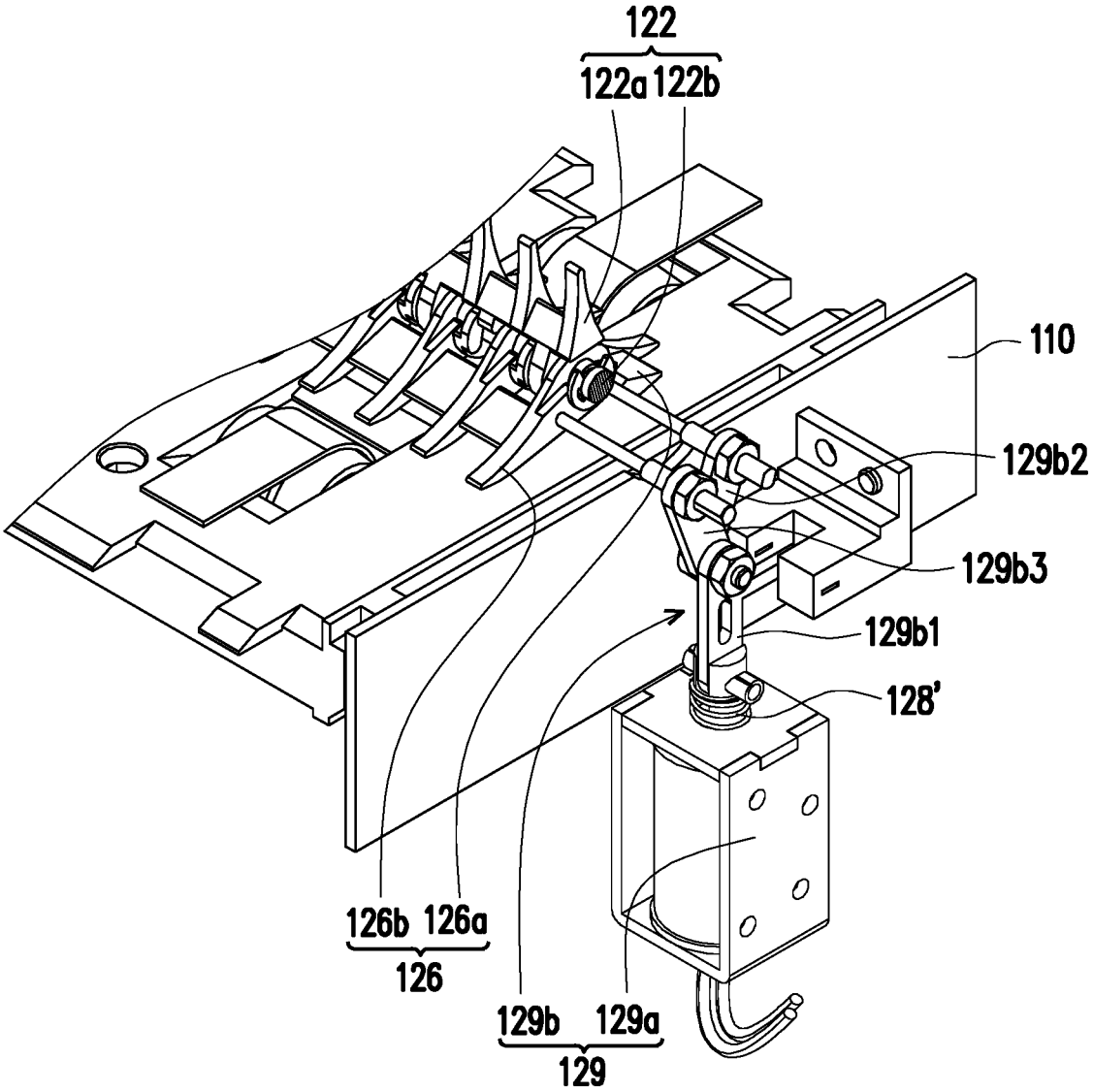
FIG. 9 is a partial perspective view illustrating a convey path switching module according to another embodiment of the invention.
Figure 10:
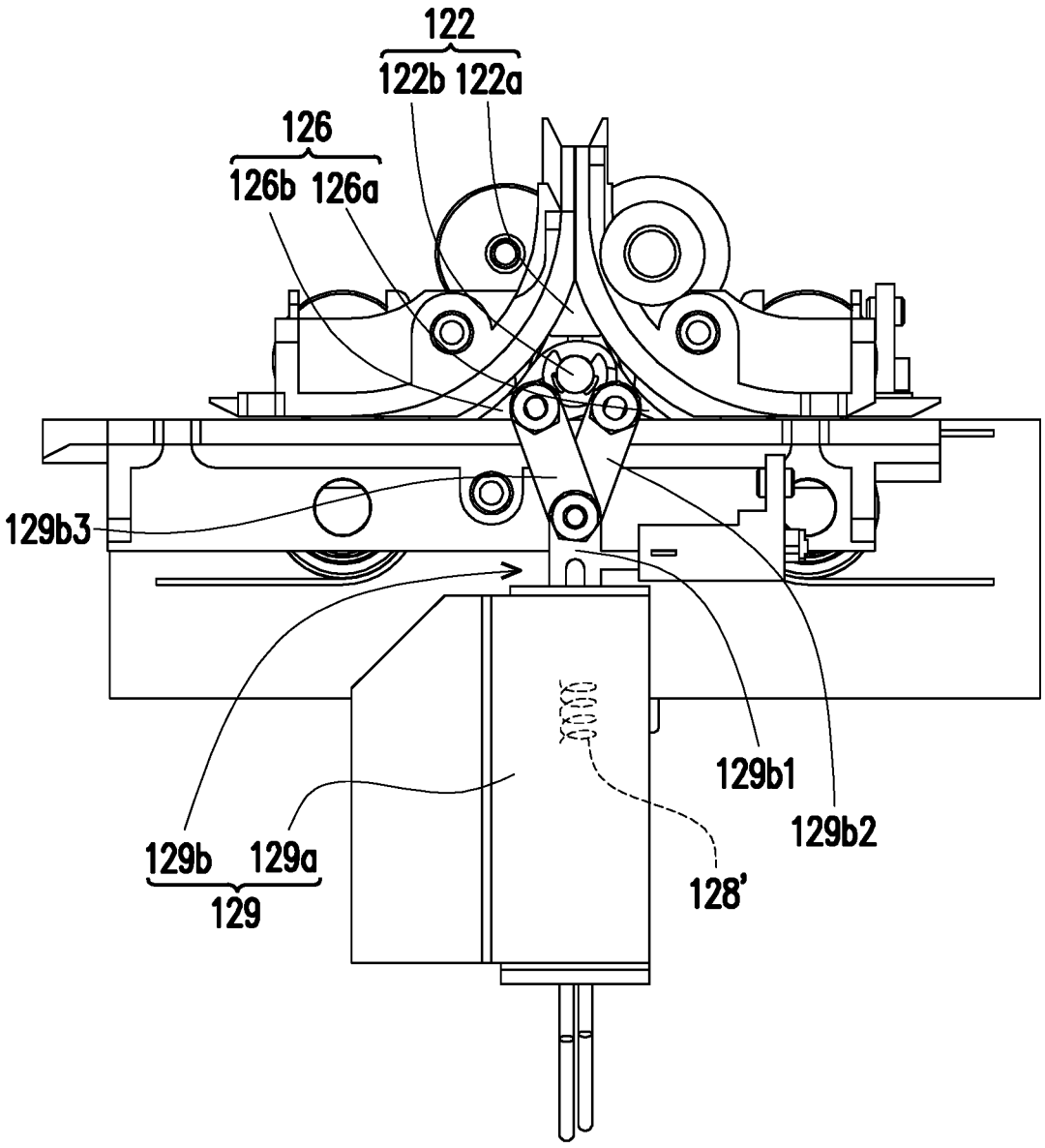
FIG. 10 is a side view illustrating the convey path switching module of FIG. 9.

FIG. 9 is a partial perspective view illustrating a convey path switching module according to another embodiment of the invention. FIG. 10 is a side view illustrating the convey path switching module of FIG. 9. The embodiment shown in FIGS. 9 and 10 differs from the embodiment shown in FIGS. 1 to 8 in that the second lever 126*a* and the third lever 126*b* of the second switching assembly 126 shown in FIGS. 9 and 10 form an active switching assembly. Specifically, the convey path switching module shown in FIGS. 9 and 10 includes a second actuator 129. The second actuator 129 includes a body 129*a* and a driving member 129*b*. The driving member 129*b* is movably disposed to the body 129*a* and connected to the second lever 126*a* and the third lever 126*b*. Unlike the elastic member 128 connected between the lever and the rotary shaft in the embodiment shown in FIGS. 1 to 8, an elastic member 128' is a compression spring, for example, and is connected between the body 129*a* and the driving member 129*b*.

Figure 11A:
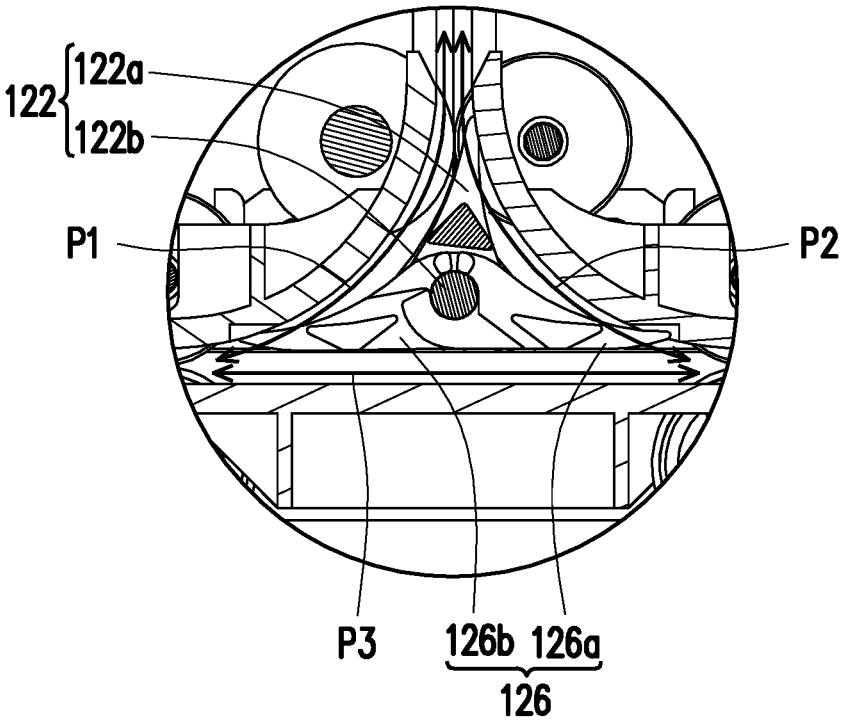
FIGS. 11A to 11C are views illustrating changes of states of a switching mechanism of FIG. 10.
Figure 11B:
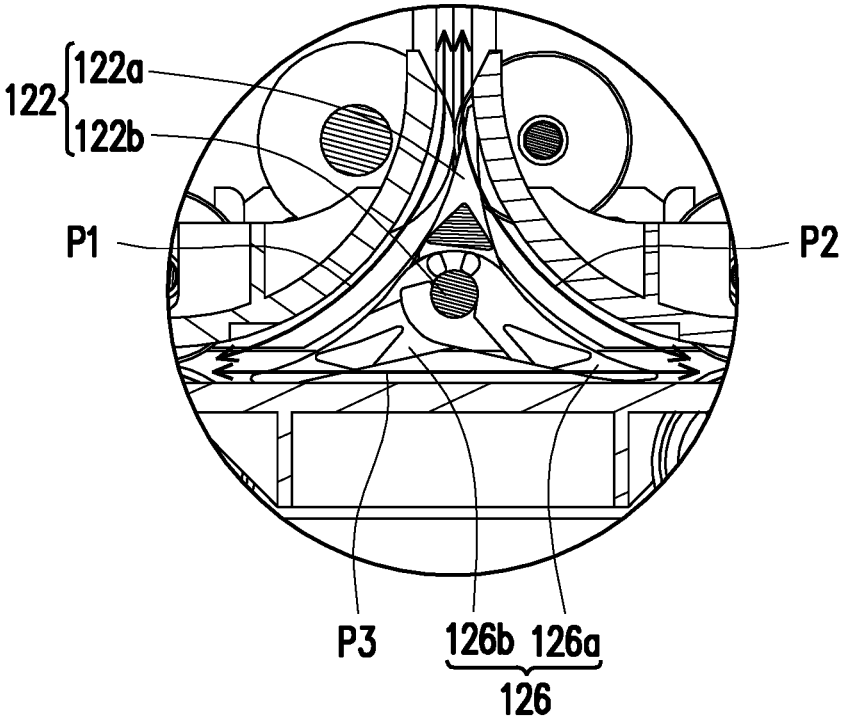
Figure 11C:
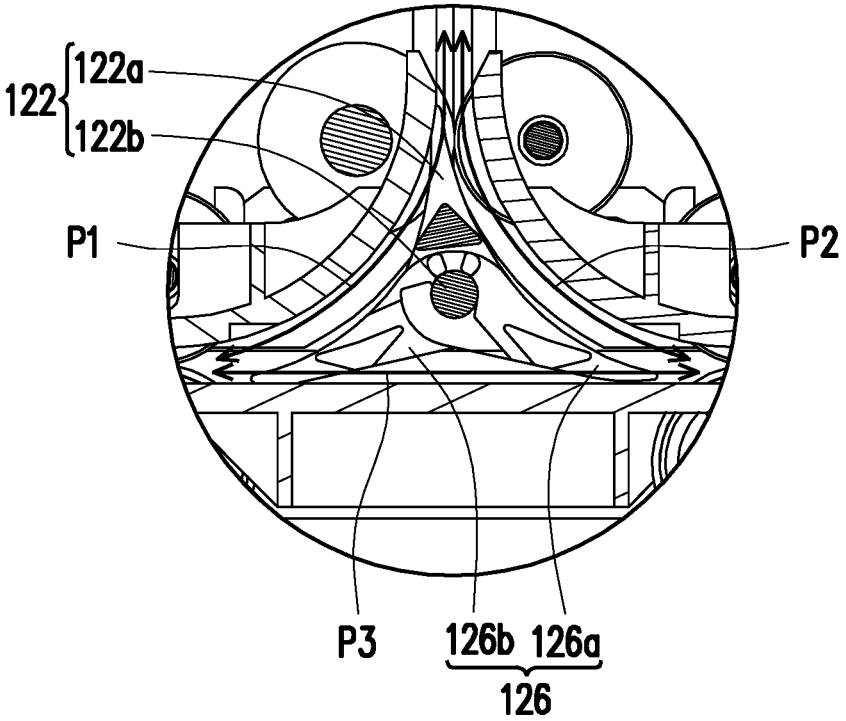

FIGS. 11A to 11C are views illustrating changes of states of a switching mechanism of FIG. 10. When the driving member 129*b* shown in FIGS. 9 and 10 is turned on, the driving member 129*b* is adapted to resist an elastic force of the elastic member 128' and be moved upward to drive the second lever 126*a* and the third lever 126*b* to respectively block the first convey path P1 and the second convey path P2 as shown in FIG. 11A. When the driving member 129*b* is turned off, the driving member 129*b*, the second lever 126*a*, and the third lever 126*b* are adapted to be moved downward and be restored by the elastic force of the elastic member 128'. Accordingly, the second lever 126*a* and the third lever 126*b* may block the third convey path P3 as shown in FIG. 11B or 11C.

Similar to the embodiment shown in FIGS. 1 to 8, when the switching mechanism of the embodiment is in the third state (corresponding to the state shown in FIG. 11A), the second lever 126*a* and the third lever 126*b* are adapted to guide an object to move bidirectionally along the third convey path P3. What differs from the embodiment shown in FIGS. 1 and 8 is that, since the second lever 126*a* and the third lever 126*b* of the embodiment may be maintained in the state shown in FIG. 11B or 11C by the elastic force of the elastic member 128' and keep the first convey path P1 or the second convey path P2 opened, when the switching mechanism is in the first state (corresponding to the state shown in FIG. 11B), the first lever 122*a* and the second lever 126*a* are adapted to guide the object to move bidirectionally along the first convey path P1. In addition, when the switching mechanism is in the second state (corresponding to the state shown in FIG. 11C), the first lever 122*a* and the third lever 126*b* are adapted to guide the object to move bidirectionally along the second convey path P2.

More specifically, the driving member 129*b* of the embodiment includes a first rod member 129*b*1, a second rod member 129*b*2, and a third rod member 129*b*3. The first rod member 129*b*1 is disposed to the body 129*a* and movable along a linear direction, two ends of the second rod member 129*b*2 are respectively pivotally connected to the first rod member 129*b*1 and the second lever 126*a*, and two ends of the third rod member 129*b*3 are respectively pivotally connected to the first rod member 129*b*1 and the third lever 126*b*. When the first rod member 129*b*1 resists the elastic force of the elastic member 128' and is moved upward, the first rod member 129*b*1 respectively drives the second lever 126*a* and the third lever 126*b* to pivotally rotate upward through the second rod member 129*b*2 and the third rod member 129*b*3. When the first rod member 129*b*1 is moved downward by the elastic force of the elastic member 128', the first rod member 129*b*1 respectively drives the second lever 126*a* and the third lever 126*b* to pivotally rotate downward through the second rod member 129*b*2 and the third rod member 129*b*3.

With the configuration, the first lever 122*a* of the first switching assembly 122 is driven by the first actuator 124 to rotate pivotally, and the second lever 126*a* and the third lever 126*b* of the second switching assembly 126 are driven by the second actuator 129 to rotate pivotally. In other words, with only two actuators (i.e., the first actuator 124 and the second actuator 129), three levers (i.e., the first lever 122*a*, the second lever 126*a*, and the third lever 126*b*) may rotate pivotally to switch the states among three convey paths (i.e., the first convey path P1, the second convey path P2, and the third convey path P3). Therefore, such configuration does not require three actuators to switch the states among the three convey paths. Consequently, the required quantity of the actuators is reduced, and the equipment cost is reduced. In addition, the embodiment exhibits a desirable convey path switching capability.

Based on the above, the second actuator 129 of the embodiment simultaneously drives the second lever 126*a* and the third lever 126*b* to rotate pivotally. However, the invention is not limited thereto. In other embodiments, the second actuator 129 may respectively and independently drive the second lever 126*a* and the third lever 126*b* to pivotally rotate.

Figure 12:
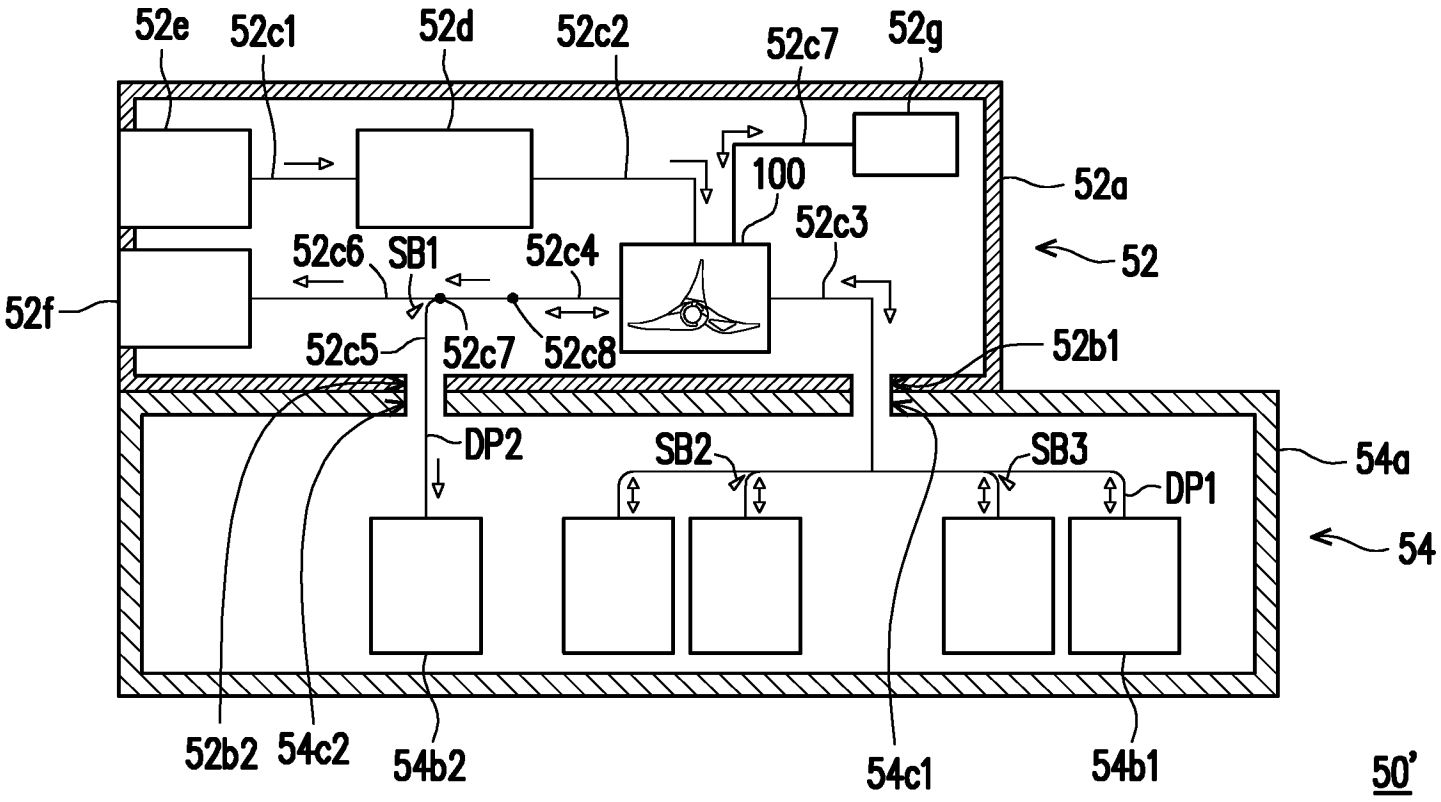
FIG. 12 is a schematic view illustrating a paper sheet handling apparatus corresponding to the convey path switch module of FIG. 9.

FIG. 12 is a schematic view illustrating a paper sheet handling apparatus corresponding to the convey path switch module of FIG. 9. A paper sheet handling module 50' of the embodiment further includes a temporary storage region 52*g* disposed in the casing 52*a*. Since the first convey path P1 and the second convey path of the embodiment are bidirectionally movable paths, the convey path set may further convey a paper sheet upward from the convey path switching module 100 to the temporary storage region 52*g* through the convey path 52*c*7 to store the paper sheet temporarily in addition to conveying the paper sheet downward to the paper sheet storage module 54.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A convey path switching module, comprising:

a body, having a first convey path, a second convey path, and a third convey path adapted to convey an object; and a switching mechanism, comprising:

a first switching assembly, pivotally connected to the body;

a first actuator, connected to the first switching assembly and adapted to drive the first switching assembly to pivotally rotate;

a second switching assembly, pivotally connected to the body and adapted to rotate pivotally; and at least one elastic member, connected to the second switching assembly adapted to be restored by an elastic force of the elastic member, wherein through pivotal rotation of the first switching assembly and pivotal rotation of the second switching assembly, the switching mechanism is adapted to be switched to a first state to open the first convey path and close the second convey path and the third convey path, adapted to be switched to a second state to open the second convey path and close the first convey path and the third convey path, and adapted to be switched to a third state to open the third convey path and close the first convey path and the second convey path, and wherein the first switching assembly comprises a first lever and a rotary shaft, the first lever is connected to the rotary shaft, the rotary shaft is pivotally connected to the body and connected to the first actuator, the second switching assembly comprises a second lever and a third lever, and the second lever and the third lever are pivotally connected to the rotary shaft, and wherein the convey path switching module further comprises a second actuator, the second actuator comprises a body and a driving member, the driving member is movably disposed to the body and connected to the second lever and the third lever, the elastic member is connected between the body and the driving member, and the driving member is adapted to make the second lever and the third lever respectively block the first convey path and the second convey path by an elastic force of the elastic member and adapted to resist the elastic force of the elastic member to move and drive the second lever and the third lever to block the third convey path, and wherein the driving member comprises a first rod member, a second rod member, and a third rod member, the first rod member is disposed to the body and movable along a linear direction, two ends of the second rod member are respectively pivotally connected to the first rod member and the second lever, and two ends of the third rod member are respectively pivotally connected to the first rod member and the third lever.

2. The convey path switching module as claimed in claim 1, wherein when the switching mechanism is in the first state, the first lever and the second lever are adapted to guide the object to move bidirectionally along the first convey path, when the switching mechanism is in the second state, the first lever and the third lever are adapted to guide the object to move bidirectionally along the second convey path, and when the switching mechanism is in the third state, the second lever and the third lever are adapted to guide the object to move bidirectionally along the third convey path.

3. The convey path switching module as claimed in claim 1, wherein when the first lever blocks the second convey path and the second lever blocks the third convey path, the switching mechanism is in the first state, when the first lever blocks the first convey path and the third lever blocks the third convey path, the switching mechanism is in the second state, and when the second lever and the third lever respectively block the first convey path and the second convey path, the switching mechanism is in the third state.

4. The convey path switching module as claimed in claim 1, wherein the second lever has a first blocking section, the third lever has a second blocking section, and the first blocking section and the second blocking section are adapted to block each other to limit ranges of pivotal rotation of the second lever and the third lever.

5. A paper sheet handling module, comprising:

a casing, having an inlet, an outlet, and an opening, wherein a convey path set is provided in the casing, and the paper sheet handling module is adapted to receive a paper sheet via the inlet and discharge a paper sheet via the outlet;

a discrimination module, disposed in the casing and adapted to discriminate the paper sheet; and a convey path switching module, disposed in the casing, wherein the convey path set is adapted to convey the paper sheet from the inlet to the convey path switching module through the discrimination module, and the convey path switching module comprises:

a body, having a first convey path, a second convey path, and a third convey path adapted to convey the paper sheet, and connected between the convey path set and the opening, wherein the convey path set is adapted to convey the verified paper sheet from the discrimination module to the opening via the second convey path, adapted to convey the verified paper sheet from the discrimination module to the outlet via the first convey path, and adapted to convey the verified paper sheet from the opening to the outlet via the third convey path; and a switching mechanism, comprising:

a first switching assembly, pivotally connected to the body;

a first actuator, connected to the first switching assembly and adapted to drive the first switching assembly to pivotally rotate;

a second switching assembly, pivotally connected to the body and adapted to rotate pivotally; and at least one elastic member, connected to the second switching assembly adapted to be restored by an elastic force of the elastic member, wherein through pivotal rotation of the first switching assembly and pivotal rotation of the second switching assembly, the switching mechanism is adapted to be switched to a first state to open the first convey path and close the second convey path and the third convey path, adapted to be switched to a second state to open the second convey path and close the first convey path and the third convey path, and adapted to be switched to a third state to open the third convey path and close the first convey path and the second convey path, and wherein the first switching assembly comprises a first lever and a rotary shaft, the first lever is connected to the rotary shaft, the rotary shaft is pivotally connected to the body and connected to the first actuator, the second switching assembly comprises a second lever and a third lever, and the second lever and the third lever are pivotally connected to the rotary shaft, wherein the convey path switching module further comprises a second actuator, the second actuator comprises a body and a driving member, the driving member is movably disposed to the body and connected to the second lever and the third lever, the elastic member is connected between the body and the driving member, and the driving member is adapted to make the second lever and the third lever respectively block the first convey path and the second convey path by an elastic force of the elastic member and adapted to resist the elastic force of the elastic member to move and drive the second lever and the third lever to block the third convey path, and wherein the driving member comprises a first rod member, a second rod member, and a third rod member, the first rod member is disposed to the body and movable along a linear direction, two ends of the second rod member are respectively pivotally connected to the first rod member and the second lever, and two ends of the third rod member are respectively pivotally connected to the first rod member and the third lever.

6. The paper sheet handling module as claimed in claim 5, further comprises a temporary storage region disposed in the casing, wherein the convey path set is adapted to convey the paper sheet from the convey path switching module to the temporary storage region.

7. The paper sheet handling module as claimed in claim 5, wherein when the switching mechanism is in the first state, the first lever and the second lever are adapted to guide the object to move bidirectionally along the first convey path, when the switching mechanism is in the second state, the first lever and the third lever are adapted to guide the object to move bidirectionally along the second convey path, and when the switching mechanism is in the third state, the second lever and the third lever are adapted to guide the object to move bidirectionally along the third convey path.

8. The paper sheet handling module as claimed in claim 5, wherein when the first lever blocks the second convey path and the second lever blocks the third convey path, the switching mechanism is in the first state, when the first lever blocks the first convey path and the third lever blocks the third convey path, the switching mechanism is in the second state, and when the second lever and the third lever respectively block the first convey path and the second convey path, the switching mechanism is in the third state.

9. The paper sheet handling module as claimed in claim 5, wherein the second lever has a first blocking section, the third lever has a second blocking section, and the first blocking section and the second blocking section are adapted to block each other to limit ranges of pivotal rotation of the second lever and the third lever.

* * * * *